US006943740B1

(12) United States Patent
Garabedian

(10) Patent No.: US 6,943,740 B1
(45) Date of Patent: Sep. 13, 2005

(54) METHODS AND SYSTEMS FOR CONCEALING ANTENNAS

(75) Inventor: Arthur Garabedian, 1111 Glenview Dr., Fullerton, CA (US) 92632

(73) Assignee: Arthur Garabedian, Anaheim, CA (US)

( * ) Notice: Subject to any disclaimer, the term of this patent is extended or adjusted under 35 U.S.C. 154(b) by 198 days.

(21) Appl. No.: 10/134,363

(22) Filed: Apr. 26, 2002

Related U.S. Application Data

(60) Provisional application No. 60/286,748, filed on Apr. 26, 2001.

(51) Int. Cl.[7] ..... H01Q 1/32
(52) U.S. Cl. ..... 343/713; 343/711
(58) Field of Search ..... 343/711, 713

(56) References Cited

U.S. PATENT DOCUMENTS 3,725,940 A 4/1973 Siple
4,001,822 A * 1/1977 Sterzer ..... 342/44
4,290,069 A 9/1981 Duda
5,177,494 A * 1/1993 Dorrie et al. ..... 343/711
5,428,830 A 6/1995 Zerod et al.
5,579,021 A * 11/1996 Lee ..... 343/781 P
5,579,023 A 11/1996 Blaese
5,621,571 A * 4/1997 Bantli et al. ..... 359/529
5,657,008 A * 8/1997 Bantli ..... 340/933
5,977,919 A * 11/1999 Kudo et al. ..... 343/713
5,999,092 A * 12/1999 Smith et al. ..... 340/436
6,005,527 A 12/1999 Gomez et al.
6,025,784 A * 2/2000 Mish ..... 340/693.5
6,208,303 B1 3/2001 Tachihara et al.
6,239,757 B1 * 5/2001 Ishikawa et al. ..... 343/711
6,278,869 B1 * 8/2001 Lindenmeier et al. ... 455/277.1

* cited by examiner

*Primary Examiner*—Tho Phan
(74) *Attorney, Agent, or Firm*—Knobbe, Martens, Olson & Bear LLP

(57) ABSTRACT

The present invention is directed to radio antennas. A front license plate is used as a first antenna and a second license plate is used as a second antenna. The front and rear license plates are coupled to respective taps on a radio frequency (RF) divider circuit, allowing the front and rear license plates to transmit and receive radio signals simultaneously.

20 Claims, 5 Drawing Sheets

METHODS AND SYSTEMS FOR CONCEALING ANTENNAS

PRIORITY CLAIM

This application claims the benefit under 35. U.S.C. 119(e) of U.S. Provisional Application No. 60/286,748, filed Apr. 26, 2001, which is incorporated by reference herein in its entirety.

BACKGROUND OF THE INVENTION

1. Field of the Invention

The present invention relates generally to antennas for radio frequency signal reception and transmission, and in particular to antennas for motor vehicles.

2. Description of the Related Art

In many applications it is desirable to conceal automotive radio antennas. For example, police using undercover cars typically do not want to use a two-way radio antenna that would identify a car as a police car. Conventionally, police sometimes conceal a two-way radio antenna by disguising the two-way radio antenna as a typical whip AM/FM radio antenna. However, as many cars no longer are equipped with whip antennas, such a disguise is no longer possible in some instances.

Another approach conceals a single antenna behind a bumper. However, a single antenna fails to provide the enhanced reception of a two-antenna diversity antenna system. Thus, police and other users of disguised antennas need an alternative technique for concealing two-way radio antennas.

SUMMARY OF THE INVENTION

The present invention is directed to radio antennas. In particular, an antenna conductor is concealed using or behind vehicle components, such as using or behind one or more license plates and/or vehicle bumpers. Radio waves are easily blocked or reflected by large objects. This is particularly true of VHF and UHF radio signals. A diversity antenna system uses two antennas mounted at different locations on a vehicle. Therefore, different embodiments of the present invention use two antennas, such as two license plates, or a bumper and a license plate. The two antenna system embodiment causes reception to be improved, as the signal received by the antenna system is less likely to be interrupted by buildings or other structures. Other embodiments use only one antenna, such as a single license plate, to reduce costs and ease installation.

In one embodiment a front license plate is used as a first antenna and a rear license plate is used as a second antenna. The front and rear license plates are coupled to respective taps on a radio frequency (RF) divider circuit, allowing the front and rear license plates to transmit and receive radio signals simultaneously.

The divider circuit may be remotely located from the front and rear license plates and can be, for example, mounted on the vehicle's chassis or in the vehicle's engine compartment, passenger compartment or trunk. The divider circuit is coupled to a transceiver, such as a HF, a UHF, a VHF, a 800 MHz, or a 900 MHz transceiver. The wiring from the divider circuit to the front and rear license plates can be correspondingly concealed in part behind the front and rear bumpers. In another embodiment, an antenna is concealed behind the front or rear bumper skin.

In a further example embodiment, a dual band antenna system is provided. An input port of the divider circuit is routed to two separate filter networks, each one tuned for a different corresponding frequency range or band, such as VHF and UHF. A first transceiver for a first band is connected to a first of the two filter networks and a second transceiver for a second band is connected to a second of the two filter networks. This configuration advantageously enables an operator to transmit on both the first and second bands at the same time or at different times without significant interference with the transceivers receivers.

BRIEF DESCRIPTION OF THE DRAWINGS

Embodiments of the present invention will now be described with reference to the drawings summarized below. These drawings and the associated description are provided to illustrate example embodiments of the invention, and not to limit the scope of the invention.

DETAILED DESCRIPTION OF THE PREFERRED EMBODIMENT

The present invention is directed to concealed or disguised automotive vehicle antennas. As will be described in greater below, in one embodiment, a motor vehicle license plate is advantageously used as an antenna.

Figure 1A:
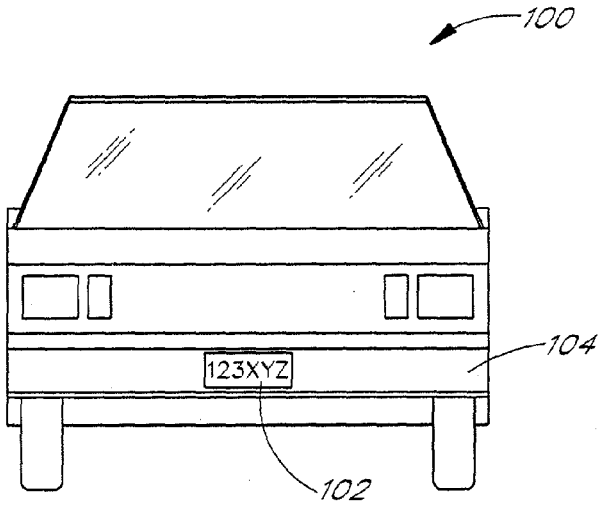
FIGS. 1A–B illustrates an automotive vehicle incorporating an example embodiment of the present invention.
Figure 1B:
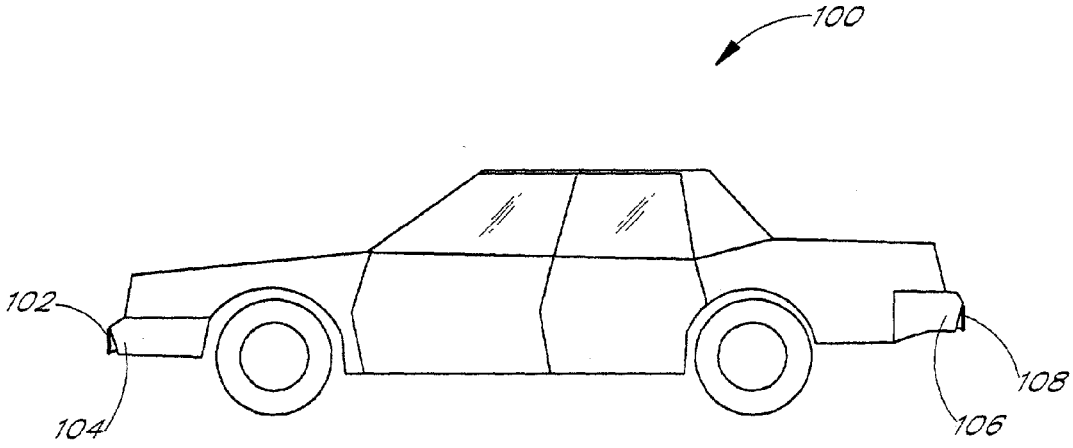

Referring first to FIG. 1A, a front view of a motor vehicle 100 is illustrated. A front mounted license plate 102 is used as an antenna, as described in greater detail below. It has been determined that the size and shape of a license plate provides good antenna characteristics for many radio bands. Wiring to the license plate 102 is concealed behind the front bumper 104. Similarly, as illustrated in FIG. 1B, a rear mounted license plate 108 is used as an antenna, and the wiring to the license plate 108 is concealed behind the rear bumper 106. In other embodiments only one of the front license plate 102 and the rear license plate 108 is used as an antenna. In still other embodiments the front bumper 104 and the rear bumper 106 are used to conceal antennas. In yet other embodiments, a license plate can be used as one antenna and a bumper antenna can be used as a second antenna. As described in greater detail below, each antenna is coupled to a coaxial cable having a center conductor and shield, where the center conductor is connected to the antenna. The license plates 102, 108 are electrically insulated from the vehicle body or chassis by plastic covered bumpers, insulating tape, or other insulators.

Figure 2:
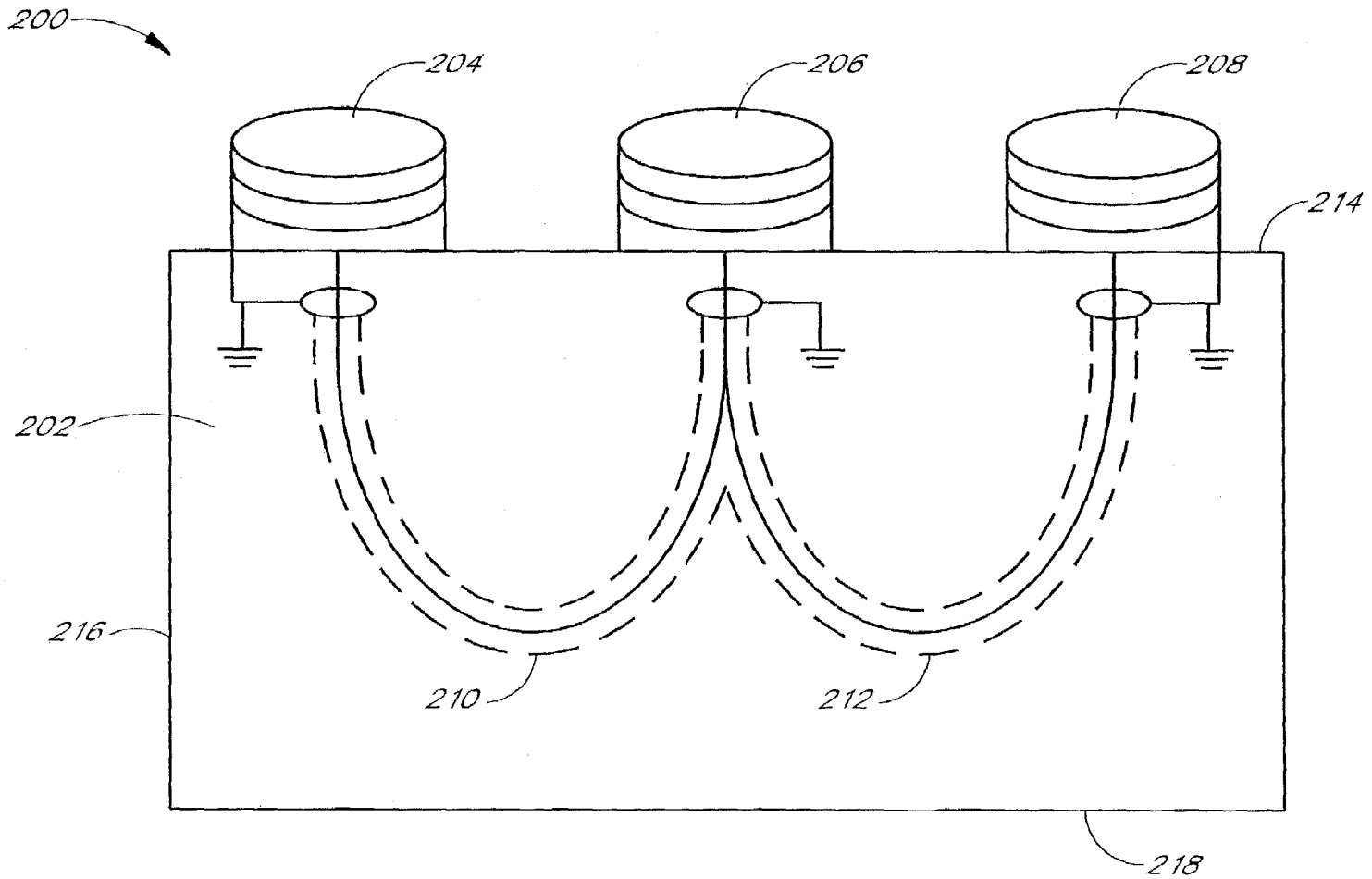
FIG. 2 illustrates a first example antenna divider circuit.

FIG. 2 illustrates an example divider circuit 200 for use with a diversity antenna system in accordance with an embodiment of the present invention. The divider circuit 200 includes a housing 202, with three ports in the form of coaxial connectors 204, 206, 208 mounted on a sidewall 214. In another embodiment, the connectors 204, 206, 208 can be mounted on different walls. For example, in one embodiment, coaxial connector 204 is mounted on sidewall 216, coaxial connector 206 is mounted on sidewall 214, and coaxial connector 208 is mounted on sidewall 218. In still another embodiment, the ports do not include connectors, but instead can be hardwired to conductors going to antennas and one or more transceiver. The housing 202 can be, by way of example, an aluminum housing.

The coaxial connector 206 is intended to be connected to one or more transceivers. The coaxial connector 204 is intended to be connected to a first antenna, such as the license plate 102 or an antenna concealed by bumper 104, and the coaxial connector 206 is intended to be connected to a first antenna, such as the license plate 108 or an antenna concealed by bumper 106. A center conductor of coaxial cable 210 connects the transceiver coaxial connector 206 to the antenna coaxial connector 204, and a center conductor of coaxial cable 212 connects the transceiver coaxial connector 206 to the antenna coaxial connector 208, and thereby to the cable 210. The cables 210, 212 are 75 ohm coax. The shields of coaxial cables 210, 212 may be grounded at both ends via the corresponding coaxial connectors 204, 206, 208 to the grounded housing 202.

In another embodiment, the coaxial cables 210, 212 are implemented as a single cable connected at some point in the middle via pigtails or the like wired through an opening in the coaxial shield to the transceiver coaxial connector 206, and connected at each end to a corresponding antenna coaxial connector 204, 208.

Transceivers often have a 50 ohm impedance. The circuit arrangement illustrated in FIG. 2 provides approximately a 50 ohm impedance as seen from the transceiver connector 206.

Figure 3:
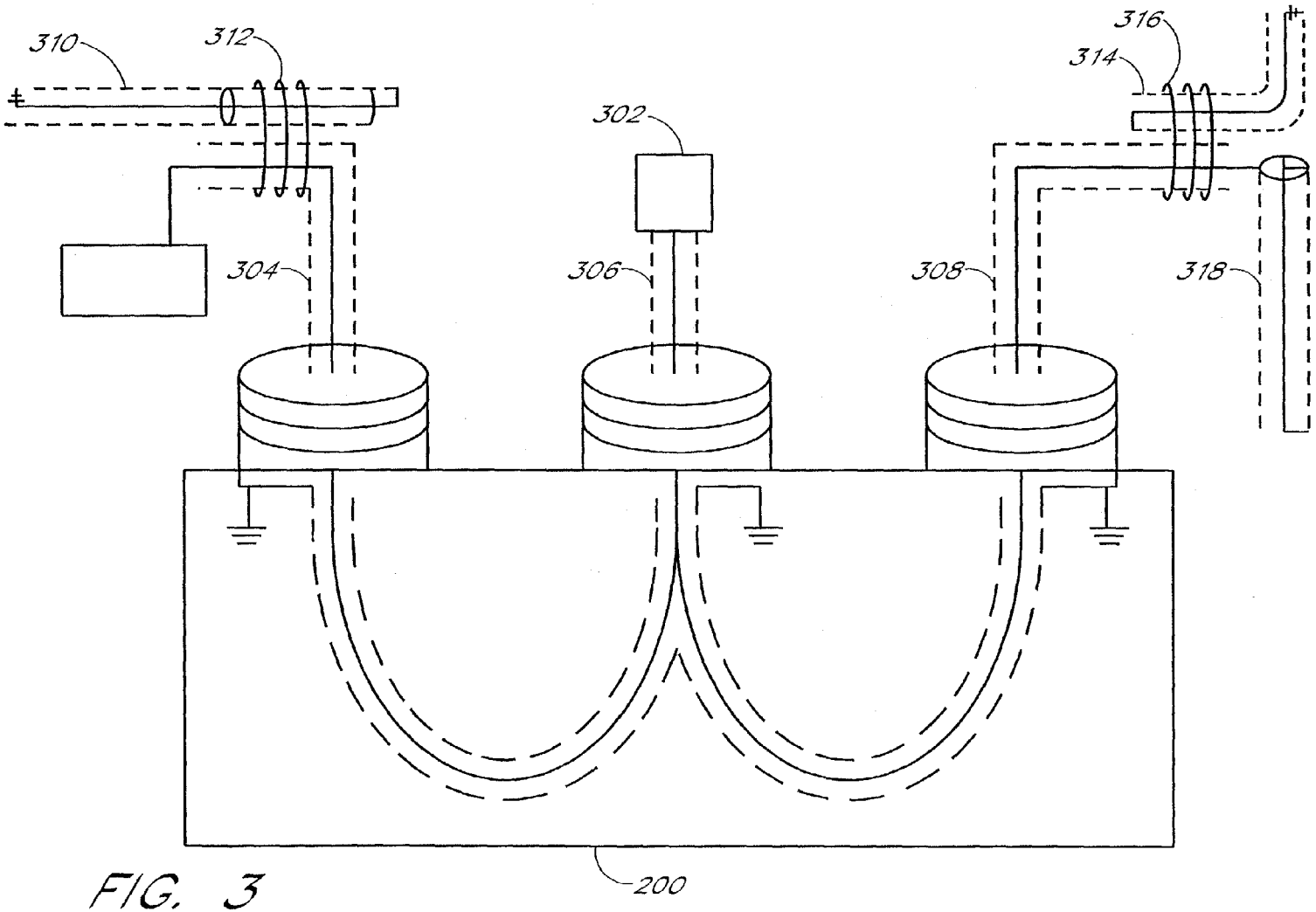
FIG. 3 illustrates a first example antenna system.

In some instances, a vehicle may have only a single license plate. This may occur, for example, in states where vehicles only require a single license plate. Therefore in one embodiment, the single license plate can be used as one antenna and a plate or coaxial line fixed to the inside of the bumper cover on the opposite of the vehicle can be used as a second antenna. FIG. 3 illustrates an antenna system using one license plate antenna 102 and one bumper antenna 318. Antennas 102, 318 are coupled via the divider circuit 200 to a transceiver 302. The cable impedance of coaxial cables 304, 306, 308 are selected to match that of the transceiver 302. As discussed above, transceivers often have a 50 ohm impedance, and so RG58 coax, having an impedance of about 50 ohms, is used in the illustrated example. The lengths of cables 304, 308, are first approximately selected to fit most vehicle installations. For example, a length of 21–23 feet for each of the cables 304, 308 is selected. However, in order to avoid standing waves and reflections, the actual cable length should be in half-wave multiples to avoid or reduce standing waves. The desired actual cable length is calculated as follows:

$$\text{Cable length}=2*(K1/Freq)*K2$$

Where:

K1=a constant (example: 234 or 245)

Freq=Operating Frequency (example: 155 MHz)

K2=a constant determined heuristically (example: 12)

The (K1/Freq) component provides the quarter-wave length frequency. Conventionally, a constant of 234 is used to calculate the quarter-wave length frequency. While the constant of 234 works well for a good 50 ohm antenna, the use of the 234 value does not work very well for an antenna that is not sufficiently close to 50 ohm. Instead, the use of the 234 value will result in an antenna system being detuned. It has been determined experimentally that a value of 245 provides an improved result with a wide bandwidth response for an antenna system using the divider circuit illustrated in FIG. 2 and a license plate antenna, assuming the license plate is approximately 6 inches high and 12 inches wide. The value of 245 can also be used in calculating the cable length when using a bumper antenna.

The quarter-wave length frequency is multiplied by 2 to generate the half-wave length frequency. The value of K2 is selected so that the result will fall somewhere within a desired range, such as between 21 and 23 feet. If a different length is desired then K2 may be varied accordingly.

Using the example values above to calculate the cable length for 155 MHz:

Cable length=2*(245/155)*12*0.6=22.7613=22 feet and 9.25 inches.

While in this example the same cable lengths for cables 304, 308 are used, in other embodiments cables 304, 308 can have different lengths.

Experimental measurements indicate that the antenna system 300 provides an advantageously low standing wave ratio (SWR) over a broad frequency band. For example, the example antenna system 300 designed for a 155 MHz provides an SWR in the range of 1.00 and 1.48 over the frequency range of 155 MHz to 174 MHz. As is well known in the art of antenna design, SWR is a measure of the mismatch between line and load impedances. The SWR indicates how much power is delivered to the load and lost in the line. With SWR=1, all power is delivered to the load. Preferably, the SWR should be less than 1.5. The ratio of the reflected voltage $V_r$ to the incident voltage $V_i$ on a transmission line is called the reflection coefficient $R(R=V_r/V_i)$. A properly terminated line will have R= 0. A shorted or open line will have R=1.

The SWR in terms of the reflection coefficient is:

$$SWR = \frac{1+R}{1-R}$$

The SW in terms of power is:

$$\frac{1+\sqrt{P_{REF}/P_{FOR}}}{1-\sqrt{P_{REF}/P_{FOR}}}$$

where:

$P_{REF}$ is reflected power $P_{FOR}$ is forward power

An antenna system in accordance with an example embodiment provides a very high percentage of the transmitter power to the antennas.

The length of the bumper antenna 318 is calculated using the value of 245. The bumper antenna is, in one embodiment, a 50 ohm coaxial cable with the shield optionally soldered to the center conductor at one or both ends. The length should be a quarter wave length. Thus, the bumper antenna cable is calculated as follows:

Antenna length=(K1/Freq)

Where:

K1=a constant (example: 245)

Freq=Operating Frequency (example: 155 MHz)

Using the above example values, in one embodiment the antenna length is approximately 1.58 feet.

Cable 304 is coupled to license plate 102 by soldering or crimping a terminal or other connector to the center conductor and then bolting the connector to the license plate 102 using an electrically insulated or plastic nut.

A ground "plane" is provided as a reference for each antenna 102, 318 in the form of 50 ohm coaxial cables 310,

314. The shields of the cable 304, 308 are correspondingly electrically connected to the shields of cables 210, 314 by wrapping conductive wires 312, 316 multiple times around and soldered to contact the corresponding shields. The length of the cables 310, 314 should also be a quarter wavelength long and may be calculated using the same equations as that used for calculating the antenna length, except that a value of 234 is used for the constant K1. In one embodiment, the length of each of the cables 310, 314 is approximately 1.5 feet.

If a diversity antenna system is not desired, then the divider circuit 200 is not needed. In such an embodiment, the transceiver can be directly wired to the license plate with the appropriately tuned coaxial cabling.

Figure 4:
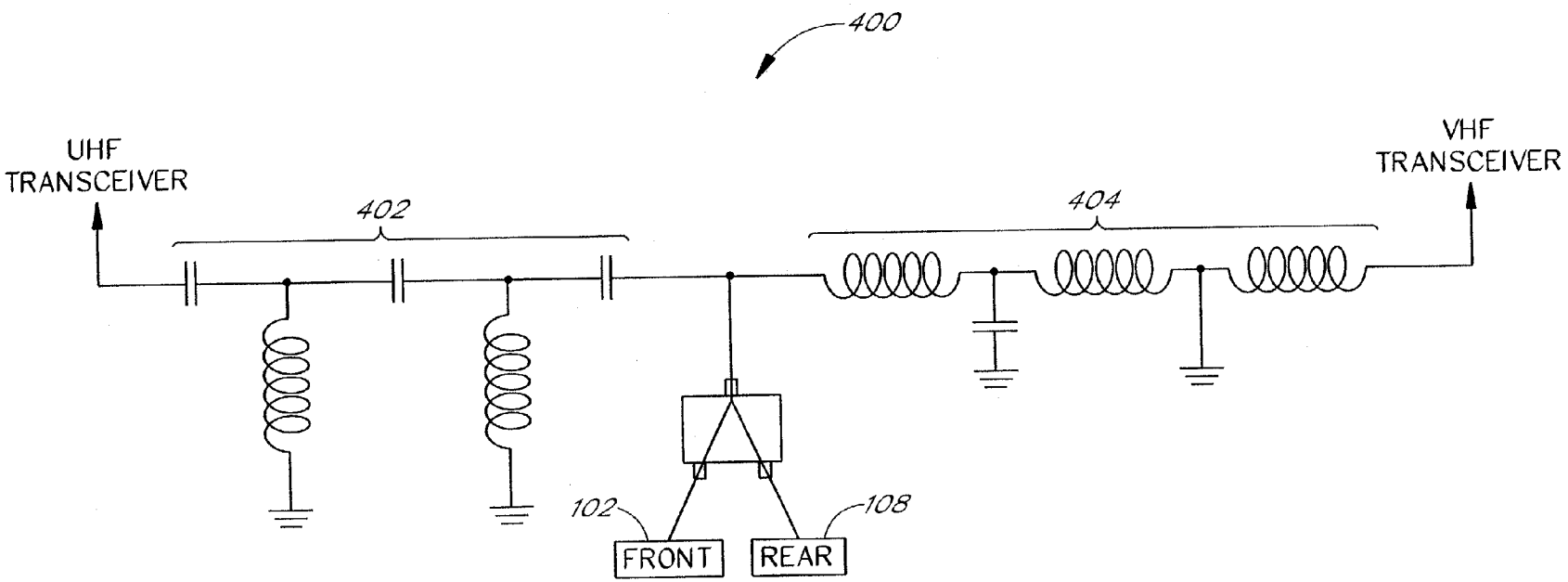
FIG. 4 illustrates an example dual-band second antenna system

FIG. 4 illustrates an example dual-band antenna system that advantageously permits the antennas to transmit and receive on two bands. The circuit divider circuit 200 is connected to the front license plate 102 and the rear license plate 108 as similarly described above. The divider circuit's 200 transceiver connector is connected to a first filter circuit 402 and a second filter circuit 404. The first filter circuit 402 includes a capacitor-inductor network, where the inductors provide a path to ground. The first filter circuit 402 permits RF signals of a first band, such as a UHF band, to pass from a UHF transceiver transmitter section to the divider circuit 200 while filtering out RF signals of a second band, such as a VHF band, transmitted from the transmitter section of a second transceiver, such as a VHF transceiver. Similarly, the second filter circuit 404 permits RF signals of the second band to pass from the UHF transceiver transmitter section to the divider circuit 200 while filtering out RF signals of the first band transmitted from the transmitter section of the first transceiver. In other embodiments, rather than using filters comprised of inductors and capacitors, transmission lines may be used. Transmission lines of appropriate length and impedance and either shorted or open, act like resonant or reactive circuits and can be used to replace conventional LC tuned circuits.

Figure 5:
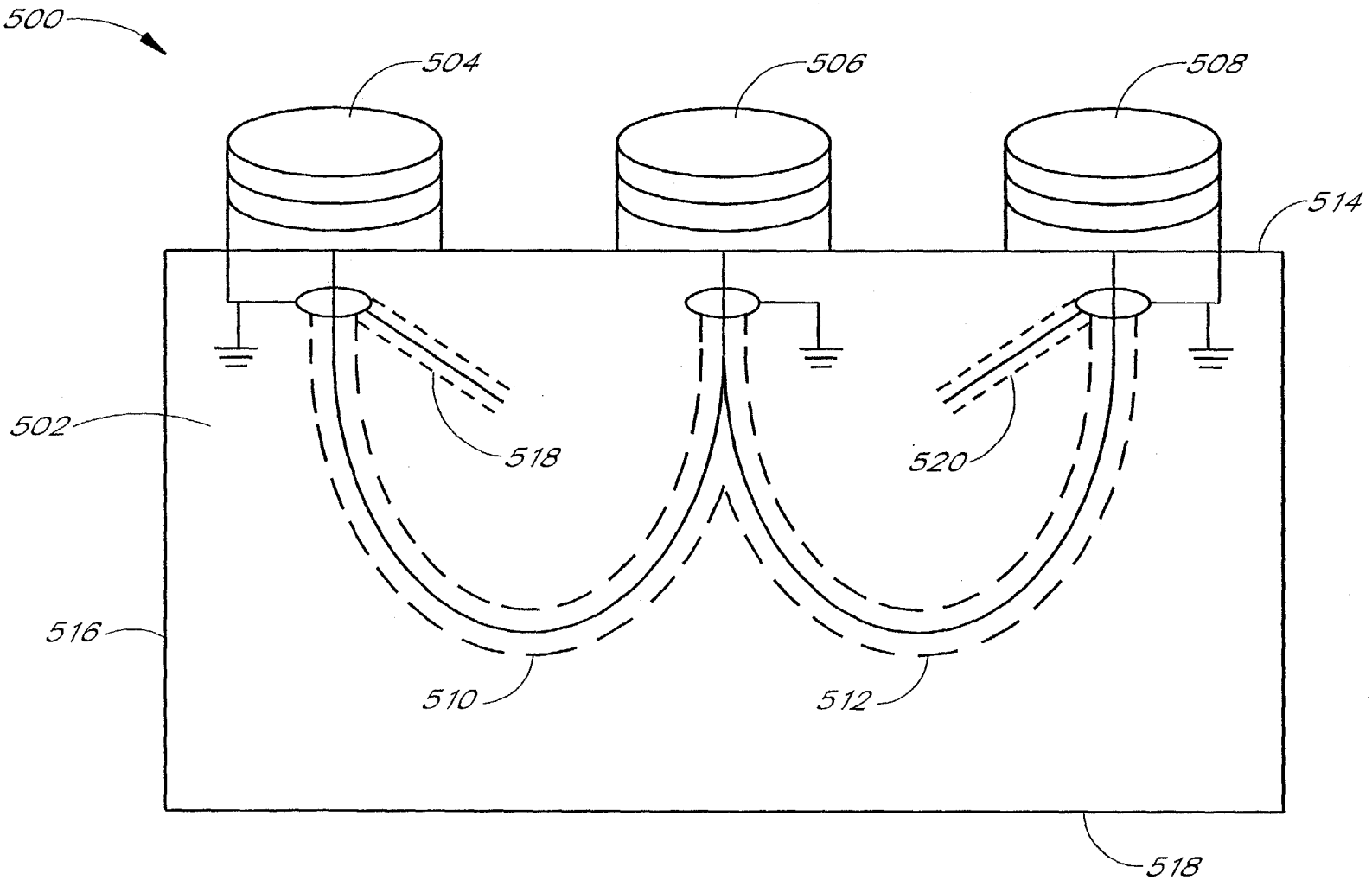
FIG. 5 illustrates a second example antenna divider circuit.

FIG. 5 illustrates a second example divider circuit 500 similar to that illustrated in FIG. 2, except 50 ohm coaxial cable is used rather than 75 ohm coax, and shorted stubs are provided for tuning. The divider circuit 500 includes a housing 502, with three coaxial connectors 504, 506, 508 mounted on a sidewall 514. In another embodiment, the connectors 504, 506, 508 can be mounted on different walls. For example, in one embodiment, coaxial connector 504 is mounted on sidewall 516, coaxial connector 506 is mounted on sidewall 514, and coaxial connector 508 is mounted on sidewall 518.

The coaxial connector 506 is intended to be connected to a transceiver. The coaxial connector 504 is intended to be connected to a first antenna, such as the license plate 102 or bumper 104, and the coaxial connector 506 is intended to be connected to a second antenna, such as the license plate 108 or bumper 106. A center conductor of coaxial cable 510 connects the transceiver coaxial connector 506 to the antenna coaxial connector 504, and a center conductor of coaxial cable 512 connects the transceiver coaxial connector 506 to the antenna coaxial connector 508, and thereby to the cable 510. The cables 510, 512 are 50 ohm coax. Shorted stubs 518, 520, in the form of coaxial cables, are used to tune the divider circuit 500 to the desired frequency. For use with 155 MHz, the lengths of the cables 510, 512 in this example are approximately 32.6 inches each. The shorted stubs 518, 520 are approximately 10.9 inches long.

Transceivers often have a 50 ohm impedance. The circuit arrangement illustrated in FIG. 5 provides approximately a 50 ohm impedance as seen from the transceiver connector 506.

Thus, as described above, embodiments of the present invention provide methods and systems for concealing or disguising two-way radio antennas.

Although this invention has been described in terms of certain preferred embodiments, other embodiments that are apparent to those of ordinary skill in the art are also within the scope of this invention.

What is claimed is:

1. A diversity antenna system for use with a vehicle, comprising:

a first license plate used as a first antenna;

a second license plate used as a second antenna;

a radio frequency transceiver;

a radio frequency divider circuit having a first antenna port, a second antenna port, and a transceiver port;

a first conductor electrically coupled to the first license plate and to the first antenna port;

a second conductor electrically coupled to the second license plate and to the second antenna port; and a third connector coupled to the radio frequency transceiver and the transceiver port.

2. A diversity antenna system for use with a vehicle, comprising:

a first license plate;

a second license plate;

a radio frequency transceiver;

a radio frequency divider circuit having a first antenna port, a second antenna port, and a transceiver port;

a first conductor coupled to the first license plate and to the first antenna port;

a second conductor coupled to the second license plate and to the second antenna port;

a third connector coupled to the radio frequency transceiver and the transceiver port;

a first coaxial cable having a first conductor and a first shield, wherein the first conductor is coupled to the first antenna port and to the transceiver port, and wherein the first shield is grounded; and a second coaxial cable having a second conductor and a second shield; wherein the second conductor is coupled to the second antenna port and to the transceiver port, and wherein the second shield is grounded.

3. The diversity antenna system as defined in claim 2, wherein the first coaxial cable and the second coaxial cable have an impedance of 75 ohms.

4. The diversity antenna system as defined in claim 2, wherein the first coaxial cable and the second coaxial cable have an impedance of 50 ohms.

5. A dual-band diversity antenna system, comprising:

a first license plate;

a radio frequency divider circuit having a first antenna port, a second antenna port, and a transceiver port;

a first conductor coupled to the first license plate and to the first antenna port, wherein the first license plate is intended to be used as a first antenna;

a second antenna coupled to the second antenna port;

a first filter network having a first input and first output, the first input coupled to the transceiver port, the first filter network configured to pass at least a first band to the first output and to filter out at least a second band; and a second filter network having a second input and a second output, the second input coupled to the transceiver port, the second filter network configured to pass at least the second band to the second output and to filter out at least the first band.

6. The dual-band diversity antenna system as defined in claim 5, further comprising:

a first radio frequency transmitter configured to transmit on the first band, the first radio frequency transmitter coupled to the first output; and a second radio frequency transmitter configured to transmit on the second band, the second radio frequency transmitter coupled to the second output.

7. The dual-band diversity antenna system as defined in claim 5, wherein the second antenna includes a coaxial cable shield.

8. The dual-band diversity antenna system as defined in claim 5, wherein the second antenna includes a second license plate.

9. The dual-band diversity antenna system as defined in claim 5, wherein the radio frequency divider circuit further comprises:

a first coaxial cable having a first conductor and a first shield, wherein the first conductor is coupled to the first antenna port and to the transceiver port, and wherein the first shield is grounded; and a second coaxial cable having a second conductor and a second shield; wherein the second conductor is coupled to the second antenna port and to the transceiver port, and wherein the second shield is grounded.

10. The dual-band diversity antenna system as defined in claim 9, wherein the first coaxial cable and the second coaxial cable have an impedance of 75 ohms.

11. An antenna system, comprising:

a first license plate used as a radio antenna;

a first radio frequency transceiver; and a first conductor electrically coupled to the first license plate and to the radio frequency transceiver so that the first license plate acts as a radio frequency antenna; and a radio frequency divider circuit electrically interposed between the first radio frequency transceiver and the first license plate, the radio frequency divider circuit having a first antenna port, a second antenna port, and a transceiver port.

12. The antenna system as defined in claim 11, further comprising:

a first conductor coupled to the first license plate and to the first antenna port;

a second conductor coupled to the second license plate and to the second antenna port; and a third connector coupled to the first radio frequency transceiver and the transceiver port.

13. An antenna system, comprising:

a first license plate used as a radio antenna;

a first radio frequency transceiver;

a first conductor electrically coupled to the first license plate and to the radio frequency transceiver so that the first license plate acts as a radio frequency antenna;

a bumper antenna;

a radio frequency divider circuit having a first antenna port, a second antenna port, and a transceiver port;

a first conductor coupled to the first license plate and to the first antenna port;

a second conductor coupled to the bumper antenna and to the second antenna port; and a third connector coupled to the first radio frequency transceiver and the transceiver port.

14. The antenna system as defined in claim 13, wherein the bumper antenna further comprises a coaxial cable.

15. The antenna system as defined in claim 13, wherein the bumper antenna is mounted on an inside wall of a bumper cover.

16. A method of installing an antenna system, the method comprising:

installing on a vehicle a radio frequency divider circuit having a first antenna port, a second antenna port, and a transceiver port;

electrically coupling the first antenna port to a first license plate, wherein the first license plate is intended to be used and function as a first two way antenna;

electrically coupling the second antenna port to a second antenna; and coupling a radio frequency transmitter to the transceiver port.

17. The method as defined in claim 16, wherein the second antenna includes a second license plate.

18. The method as defined in claim 16, wherein the second antenna includes a coaxial cable.

19. The method as defined in claim 16, further comprising coupling a ground reference to the first antenna port.

20. A diversity antenna system for use with a vehicle, comprising:

a first bumper antenna used as a two way radio antenna;

a second bumper antenna used as a two way radio antenna;

a radio frequency transceiver;

a radio frequency divider circuit having a first antenna port, a second antenna port, and a transceiver port;

a first conductor electrically coupled to the first bumper antenna and to the first antenna port;

a second conductor electrically coupled to the second bumper antenna and to the second antenna port; and a third connector coupled to the radio frequency transceiver and the transceiver port.

* * * * *